United States Patent [19]

Purdy et al.

[11] 4,373,756

[45] Feb. 15, 1983

[54] WHEELCHAIR TRAY ASSEMBLY

[76] Inventors: Geoffrey H. Purdy, Mine Hill Rd., Roxbury, Conn. 06783; Robert R. Jackson, Oak Summit Rd., Millbrook, N.Y. 12545

[21] Appl. No.: 197,651

[22] Filed: Oct. 16, 1980

[51] Int. Cl.[3] ..... A47B 39/00

[52] U.S. Cl. ..... 297/153; 297/149; 297/DIG. 4

[58] Field of Search ..... 297/149, 153, 148, 150, 297/151, DIG. 4, 251, 252

[56] References Cited

U.S. PATENT DOCUMENTS

| | | | |
|---|---|---|---|
| 1,008,037 | 11/1911 | Johnson | 297/153 |
| 1,882,264 | 10/1932 | Thompson | 297/149 |
| 3,383,134 | 5/1968 | Webb et al. | 297/153 |
| 3,606,450 | 9/1971 | Sedgewick | 297/153 X |
| 3,860,285 | 1/1975 | Hartman | 297/150 |
| 4,081,198 | 3/1978 | Penney | 297/153 |
| 4,266,825 | 5/1981 | Le Donne | 297/153 X |

FOREIGN PATENT DOCUMENTS

| | | | |
|---|---|---|---|
| 1460533 | 10/1966 | France | 297/153 |

*Primary Examiner*—James T. McCall

*Attorney, Agent, or Firm*—Kane, Dalsimer, Kane, Sullivan and Kurucz

[57] ABSTRACT

A wheelchair tray assembly is provided which includes spring biased hook elements to secure a tray to the arms of a wheelchair. The tray is mounted to tray supports which permit movement of the tray perpendicular to the direction of movement of the hook elements. The entire unit when collapsed is substantially the same size as a conventional cafeteria tray.

7 Claims, 3 Drawing Figures

WHEELCHAIR TRAY ASSEMBLY

BACKGROUND OF THE INVENTION

The present invention relates to wheelchair attachments and in particular to a tray or work surface adapted to be easily attached to and removed from a wheelchair.

A problem encountered by many wheelchair confined persons is that they have difficulty handling and maneuvering the conventional tray used in the cafeterias of many companies, schools, public institutions and the like. Also, because the wheelchair confined person must use his hands to operate his chair, he cannot readily hold and fill a tray while moving along the cafeteria line, when moving from parts bins to workbench, or just carrying objects that need be stable. Attempts to balance the conventional tray on the arms of a wheelchair are at best hazardous and the use of special trays in cafeterias pose sanitary and waste handling problems since most such cafeterias have conveyor systems on which soiled trays and dishes must be placed before being fed to a washer. Such conveyors are designed to accept a conventional size tray and any variance from the conventional tray size could pose feed problems.

In view of the above, it is a principal object of the present invention to provide an improved wheelchair tray assembly which quickly and easily may be attached to any wheelchair regardless of the width of the chair.

A further object is to provide such a tray assembly which, when attached to a wheelchair, leaves the occupants hands free to wheel the chair or operate the controls that move it.

A still further object is to provide such a tray assembly which is substantially the same size as a conventional cafeteria tray and which thus may readily be handled by conventional washing equipment.

A still further object is to provide such a tray assembly which, when removed from the wheelchair, may stand freely on a table surface thereby permitting the wheelchair occupant to sit at a regular table, desk or workbench with his co-workers.

Still another object of the invention is to provide a tray assembly which, when attached to a wheelchair, may be slid forward or back to accommodate persons of various waistline sizes.

Still other objects and advantages will become apparent from the following description of the invention.

SUMMARY OF THE INVENTION

The above and other beneficial objects and advantages are attained in accordance with the present invention by providing a wheelchair tray assembly consisting of a tray secured to a framework. The framework includes a pair of elongated parallel tubes with each of the tubes in turn comprising telescoped male and female parts. Spring means bias the female part into its associated male part. The free ends of the telescoped tubes are connected by transverse members to which hooks are secured with the hooks on the male transverse member being directed toward the female transverse member and vice versa. The transverse members may thus be moved away from each other against the springs to increase the distance between the hooked elements and thereafter, upon release, will be brought back toward each other under action of the springs.

A pair of slide assemblies secure the tray to the framework. Each slide assembly is slidably secured to the male tube parts and is also secured to the tray. The tray supports extend generally perpendicular to the telescoped tubes so that the tray may be shifted transverse to the tubes.

The arrangement of parts is such that when the framework is collapsed (i.e., when the tray support and telescoped tubes are in their most collapsed positions) the framework substantially underlies the tray.

DETAILED DESCRIPTION OF THE PREFERRED EMBODIMENT

Figure 1:
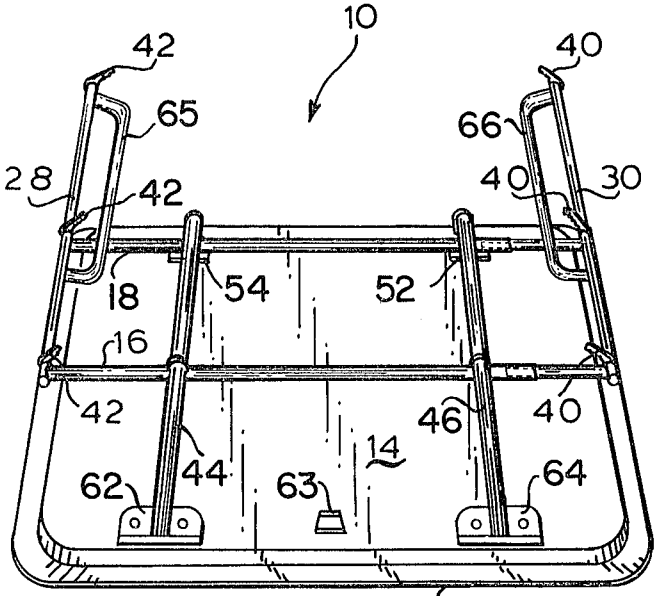
FIG. 1 is a bottom perspective view of a wheelchair tray assembly in accordance with the present invention.

Reference is now made to the drawings and to FIG. 1 in particular wherein the wheelchair tray assembly 10 in accordance with the present invention is shown as comprising a tray 12 the bottom surface 14 of which is secured to a framework which includes a pair of parallel tubes 16 and 18 extending along the length of the tray.

Figure 2:
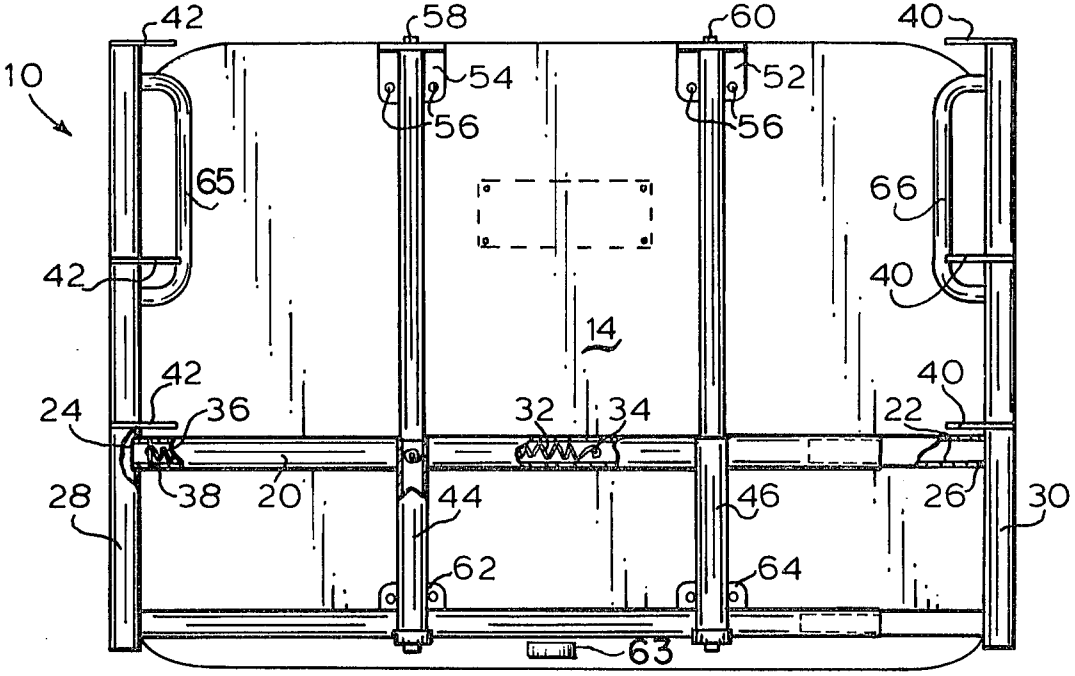
FIG. 2 is a partially fragmentary bottom plan view of the tray assembly; and, FIG. 3 is a side elevational view of the tray assembly.
Figure 3:
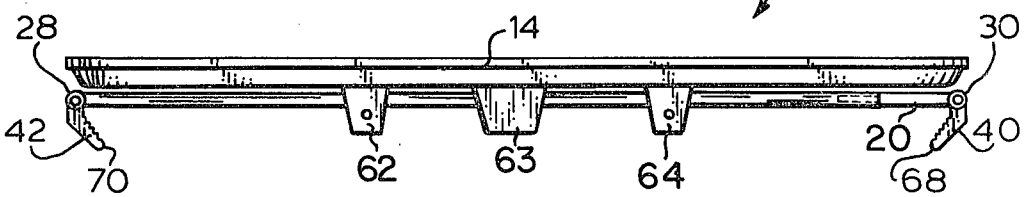

As shown in FIG. 2, tube 18 comprises a male section 20 within which a female section 22 is telescopically disposed. An identical arrangement is provided for tube 16. The free ends of tubes 16 and 18 (i.e., end 24 of male section 20 and end 26 of female section 22 for tube 16) have secured thereto transverse rods 28 and 30 respectively. Thus, rod 30 is welded or otherwise secured to end 26 of female section 22 of tube 18 and also to the corresponding female section of tube 16. Similarly rod 28 is secured to end 24 of the male section 20 and to the corresponding part of tube 16.

An elongated spring 32 is provided having one end secured to a pin 34 extending through the female tube 22 (but ground flush with the outside diameter of the female tube so as not to interfer with its sliding within the male tube 20) and the other end 36 secured to a pin 28 extending through the male tube (but clear of the female tube). A similar arrangement (not shown) is provided for tube assembly 16. The spring 32 serves to bias the telescoped male and female tubes 20 and 22 toward their collapsed position thereby biasing the transverse rods 28 and 30 toward each other.

A set of hook elements 40 is provided on rod 30 with their hook elements directed toward rod 28. Similarly, a set of hook elements 42 is provided on rod 28 with their hook elements directed toward rod 30.

The framework further includes a pair of slide members 44 and 46 secured respectively to the exterior of the male elements of telescoping tube assemblies 16 and 18. The slide members 44 and 46 are in the form of tube segments spaced apart from each other and extending generally transverse to the longitudinal axis of tubes 16 and 18. These slide members are secured to the tray by brackets 52, 54, 62 and 64 and are slidable with respect to tubes 18 and 16 shown in FIG. 2. The movement of tray 13 is limited by stop 63. A pair of brackets 52 and 54 secured to tray 14 with rivets or other appropriate fasteners 56 is secured to the female slide elements 48 and 50 with fasteners 58 and 60 respectively. As a result, the tray 14 is free to move with tubes 48 and 50 as they telescope into their male counterparts. Movement of the tray 14 is limited by stop brackets 62 and 64 which are secured to tray 14 and are captured between the spring biased assemblies 16 and 18 as shown in FIG. 2.

Tray 14 comprises a conventional cafeteria-type tray and may be formed of a plastic or a fiberglass material. Alternatively tray 14 may comprise any other desired special purpose work surface. The framework, fasteners, springs and other parts are preferably formed of an autoclavical and detergent resistant material such as stainless steel or a similar material impervious to commercial dishwashing.

In operation, the user attaches the tray assembly to his wheelchair by pulling apart transverse rods 28 and 30 against the action of the springs. A pair of grips 65 and 66 is provided on rods 28 and 30 to facilitate handling. The hook 40 and 42 must be separated a sufficient distance to enable them to stride the outside of the wheelchair arms. The transverse members are then released and the spring bias force serves to bring the transverse members back toward one another thereby locking the hooks to the arms. The user may then adjust the tray along slides 48 and 50 to assure comfortable clearance between the forward edge of the tray and his stomach and waistline. It should be noted that the tray 14 will offset to one side since it is fixed with respect to the male tube. This offset enables the area on the other side to be unobstructed and is particularly useful where there are electronic or mechanical controls for the wheelchair. Thus the operator is free to move rod 30 sideways without moving the tray since any such movement will cause the female sections of the tubes to move within the male sections.

An important feature of the present invention is that the lower ends 68 and 70 of hooks 40 and 42 lie in the same plane thereby serving as supports for the tray if the user wishes to place the tray assembly on a table, desk or workbench and use the assembly as a conventional tray.

Another important feature of the present invention resides in the fact that when the springs of tube assemblies 16 and 18 are relaxed, the transverse rods 28 and 30 underlie the side edges of tray 14. Thus the framework substantially underlies the front and rear edges of the tray. As a result, the entire assembly readily fits on commercial tray conveying equipment and with tray washing equipment.

Thus, in accordance with the above, the aforementioned objects have been effectively attained.

Having thus described the invention, what is claimed is:

1. A removable wheelchair tray assembly comprising:

a first pair of male and female telescoping members, said male and female members each having a free end;

spring means biasing said male and female members free ends toward one another;

wheelchair arm engaging hook means secured to each of said free ends;

tray support means movably secured to one of said members and adapted to move transversely with respect to said member; and a tray secured to said support means.

2. The assembly in accordance with claim 1 further comprising:

a second pair of male and female telescoping members parallel to and spaced apart from said first pair of members; and, said arm engaging hook means includes a transverse rod extending between said male member free ends, a transverse rod extending between said female member free ends, and hook elements on said male transverse member directed toward said female transverse member and on said female transverse member directed toward said male transverse member.

3. The assembly in accordance with claim 2 further comprising spring means biasing the free ends of said second pair of telescoping male and female members toward each other.

4. The assembly in accordance with claim 2 wherein said transverse rods underlie said tray when said spring means is relaxed.

5. The assembly in accordance with claim 2 wherein said tray support comprises a spaced apart pair of parallel members extending perpendicular to said first and second pair of male and female members, each of said pair of parallel members being slidingly secured to said first and second male members and to said tray to permit sliding movement in a direction perpendicular to said telescoping members.

6. The invention in accordance with claim 5 further comprising stop means secured to said tray and captured between said male telescoping members to limit the movement of said tray so that said telescoping members and support members underlie said tray when said spring means is relaxed and said stop engages one of said male telescoping members.

7. The invention in accordance with claim 1 wherein said hook means comprises a set of six hook elements capable of supporting said tray assembly on a flat surface in a plane parallel to said flat surface.

* * * * *